US011015909B2

(12) United States Patent
Roy

(10) Patent No.: US 11,015,909 B2
(45) Date of Patent: May 25, 2021

(54) PROJECTILE WITH STEERABLE CONTROL SURFACES

(71) Applicant: NEXTER MUNITIONS, Versailles (FR)

(72) Inventor: Richard Roy, Bourges (FR)

(73) Assignee: NEXTER MUNITIONS, Versailles (FR)

( * ) Notice: Subject to any disclaimer, the term of this patent is extended or adjusted under 35 U.S.C. 154(b) by 316 days.

(21) Appl. No.: 16/283,077

(22) Filed: Feb. 22, 2019

(65) Prior Publication Data

US 2019/0257628 A1 Aug. 22, 2019

(30) Foreign Application Priority Data

Feb. 22, 2018 (FR) ..... 1800164

(51) Int. Cl.

| | |
|---|---|
| ***F42B 15/01*** | (2006.01) |
| ***F42B 10/18*** | (2006.01) |
| ***F42B 10/64*** | (2006.01) |
| *F42B 10/00* | (2006.01) |

(52) U.S. Cl.

CPC ..... *F42B 15/01* (2013.01); *F42B 10/18* (2013.01); *F42B 10/64* (2013.01)

(58) Field of Classification Search

CPC ..... F42B 15/01; F42B 10/18; F42B 10/64; F42B 10/60

See application file for complete search history.

(56) References Cited

U.S. PATENT DOCUMENTS

| | | | | |
|---|---|---|---|---|
| 2,821,924 A | | 2/1958 | Hansen et al. | |
| 4,210,298 A | | 7/1980 | Liberman | |
| 4,560,121 A | * | 12/1985 | Terp | F42B 10/64 244/207 |
| 4,738,412 A | | 4/1988 | Ozunas | |
| 5,788,180 A | * | 8/1998 | Sallee | F42B 10/60 244/3.15 |
| 6,073,880 A | * | 6/2000 | Voigt | F42B 10/64 244/3.24 |

(Continued)

FOREIGN PATENT DOCUMENTS

FR 3002319 A1 8/2014

OTHER PUBLICATIONS

Nov. 19, 2018 Search Report and Written Opinion issued in French Patent Application No. 1800164.

*Primary Examiner* — Bernarr E Gregory
(74) *Attorney, Agent, or Firm* — Oliff PLC

(57) ABSTRACT

A projectile (100) with incidence steerable control surfaces (2) each pivotable with respect to the projectile (100), comprises: central control means (5) for controlling the control surfaces (2), a control arm (11) adapted to rotate the central control means (5) around pitch (Y) and yaw (Z) axes of the projectile (100), positioning means for positioning the arm (11), adapted to position one end of the arm (11) in a position determined with respect to an absolute reference frame, the positioning means comprising a cone (13) movable in translation so as to pivot the central control means around an orientation axis (AO), and a toothed wheel (16) meshing with a motorization intended to pilot the angular position of the orientation axis in an absolute reference frame.

10 Claims, 8 Drawing Sheets

(56) References Cited

U.S. PATENT DOCUMENTS

| | | | | |
|---|---|---|---|---|
| 7,246,539 | B2 * | 7/2007 | Turner | F42B 10/64 244/225 |
| 8,921,749 | B1 * | 12/2014 | Scott | F42B 10/64 244/3.27 |
| 9,163,915 | B2 | 10/2015 | Roy | |
| 9,228,815 | B2 * | 1/2016 | Rastegar | F42B 10/18 |
| 9,297,622 | B2 * | 3/2016 | Roy | F42B 10/64 |
| 9,341,453 | B2 * | 5/2016 | Rastegar | F42B 10/64 |
| 2008/0006736 | A1 * | 1/2008 | Banks | F42B 15/01 244/3.21 |
| 2011/0073705 | A1 | 3/2011 | Huguenin et al. | |

* cited by examiner

PROJECTILE WITH STEERABLE CONTROL SURFACES

The technical field of the invention is that of the projectiles guided by incidence steerable control surfaces.

BACKGROUND OF THE INVENTION

To guide a projectile to its target, it is known to use control surfaces located on the periphery of the projectile, either as a fin assembly or in a forward position (so-called canard controls). During the flight, the incidence of the control surfaces is adapted according to the desired trajectory to be given to the projectile. Piloting of the incidence is most often performed by electric motors.

Thus, patent FR3002319 describes a device for piloting control surfaces of a projectile, which are each pivotable with respect to the projectile around a pivot axis perpendicular to the longitudinal axis of the projectile. Central means for controlling the control surfaces is arranged in a housing of the projectile and comprises at least one spherical form whose center is located on the longitudinal axis. A control arm integral with the spherical form makes it possible to rotate the latter at least around the pitch and yaw axes of the projectile passing through the center of the spherical form.

Each control surface comprises a transmission member which cooperates with the spherical form by a first side and with a control surface foot by a second side. The transmission member transmits to the control surface the rotation movements of the spherical form around the pivot axis of the control surface. Means for positioning the arm makes it possible to position one end of the arm in a position determined with respect to an absolute reference frame centered on the longitudinal axis of the projectile.

A projectile thus equipped remains complicated to manipulate due to the continuous rotation of the control surfaces around the longitudinal axis of the projectile. Furthermore, the transmission of the rotation from the spherical form to the control surface foot is imperfect.

BRIEF SUMMARY

The invention proposes a projectile provided with a steering device easier to manipulate. The invention also proposes means providing a more effective transmission of the movements from the spherical form to the control surfaces.

Thus, the invention relates to a projectile with incidence steerable control surfaces, the projectile comprising at least two control surfaces, each control surface being pivotable with respect to the projectile around a pivot axis perpendicular to a longitudinal axis of the projectile, the projectile comprising:

central control means for controlling the control surfaces, the central control means comprising at least one spherical form a center of which is located on the longitudinal axis, the spherical form being arranged in a housing of the projectile, a control arm integral with the spherical form and adapted to rotate the spherical form at least around the pitch and yaw axes of the projectile passing through the center of the spherical form, for each control surface, a transmission member cooperating with the spherical form by a first side and with a foot of the control surface by a second side, the transmission member being intended to transmit to the control surface the rotation movements of the spherical form around the pivot axis of the control surface, positioning means for positioning the arm, the positioning means being adapted to position one end of the arm in a position determined with respect to an absolute reference frame centered on the longitudinal axis of the projectile, wherein:

the positioning means comprises a cone movable in translation along the longitudinal axis of the projectile between a first, so-called neutral, position and a second, so-called piloting, position in which the cone pushes a ramp carried by a first end of the control arm so as to pivot the central control means around a so-called orientation axis passing through the center of the central control means, the central control means is freely rotatable around the longitudinal axis of the control arm, the positioning means comprises a toothed wheel centered on the longitudinal axis of the projectile and connected to a second end of the arm by a sliding connection located in the plane of the toothed wheel and perpendicular to the orientation axis, the toothed wheel meshing with a motorization intended to pilot the angular position of the orientation axis in an absolute reference frame.

Advantageously, the positioning means return comprises means for returning the arm to a position aligned with the longitudinal axis of the projectile, thus placing the control surfaces at zero incidence.

Advantageously, the return means is integral in translation with the cone and comprises a bore coaxial to the longitudinal axis of the projectile and an edge of which is intended to interfere with a counter-ramp of the arm when the cone returns in neutral position by moving away from the first ramp.

Advantageously, the cone is integral with a cage which surrounds the cone and carries the bore.

Advantageously, the positioning means comprises locking means for locking the control surfaces in a position folded in the projectile.

Advantageously, the locking means comprises a bent outer edge integral with the cage, the edge being intended to cooperate with a notch of a leading edge of a control surface in order to maintain the control surface folded when the cone is in the neutral position.

Advantageously, the spherical form comprises, for each control surface, a groove oriented along a meridian line of the spherical form and starting from the control arm, the grooves being arranged parallel to the longitudinal axis of the projectile when the control surfaces themselves are parallel to the longitudinal axis of the projectile.

Advantageously, each groove cooperates with a profile, so-called second profile, of the transmission member that corresponds to the groove, the second profile being adapted to slide and pivot in the groove.

Advantageously, the transmission member comprises a profile, so-called first profile, that is parallel to the second profile, the first profile cooperating with a slot carried by the foot of the control surface, the first profile being adapted to slide and pivot in the slot.

Advantageously, the first and second profiles of the transmission member each comprise a lobe shape adapted to cooperate, on one hand, with the grooves of the spherical form and, on the other hand, with the slot of the control surface foot.

BRIEF DESCRIPTION OF THE DRAWINGS

The invention will be better understood upon reading the following description, made with reference to the appended drawings in which.

DETAILED DESCRIPTION OF THE INVENTION

Figure 1:
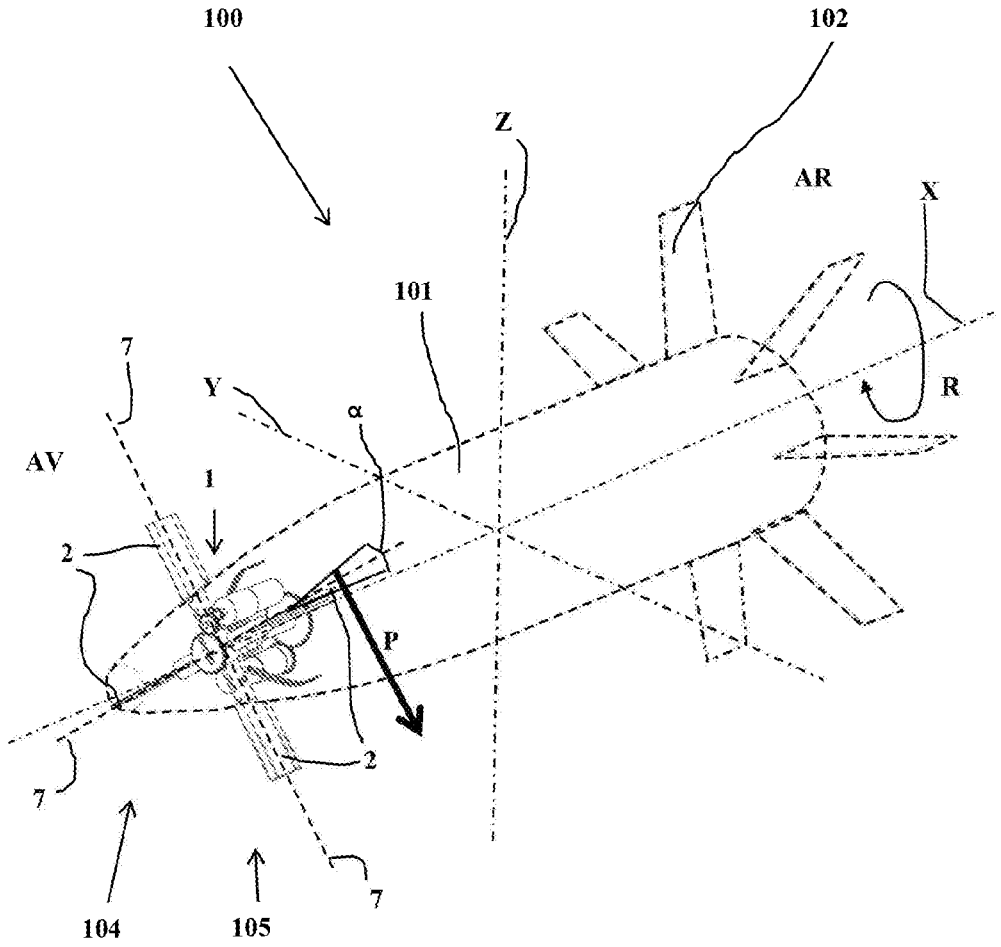
FIG. 1 shows a schematic view of an airborne projectile according to the invention.

According to FIG. 1, an airborne projectile 100 comprises a substantially cylindrical body 101. This projectile 100 comprises, at its rear part AR, a fin assembly having fixed-incidence fins 102 intended to stabilize the projectile 100 along its pitch Y and yaw Z axes. The projectile 100 has a rotation movement R around its longitudinal axis, referred to as a roll axis X.

At the front part AV of the projectile 100, there is a steering device 1 accommodated within a warhead 104 and comprising control surfaces 2 that are integral with the projectile 100 and each pivotable on a control surface axis 7 perpendicular to the roll axis X so as to change their incidence. To make the projectile take a curved trajectory, it is necessary to control, on one hand, the curvature radius of the curve and, on the other hand, the orientation of the curve. For this manipulation, the incidence $\alpha$ of the control surfaces will thus be varied so as to generate a lift force P radial to the longitudinal axis X of the projectile. Furthermore, it is necessary to angularly direct this force P around this same axis X and with respect to an absolute reference frame in order to favorably steer the projectile 100 on a desired trajectory.

As the control surfaces 2 are integral with the projectile 100, they also have the same rotation movement R around the roll axis X as the projectile 100, thereby implying that the steering device 1 should vary the incidence of the control surfaces 2 proportionally to their angular orientation in an absolute reference frame, so as to achieve a direction desired for the projectile.

Figure 2:
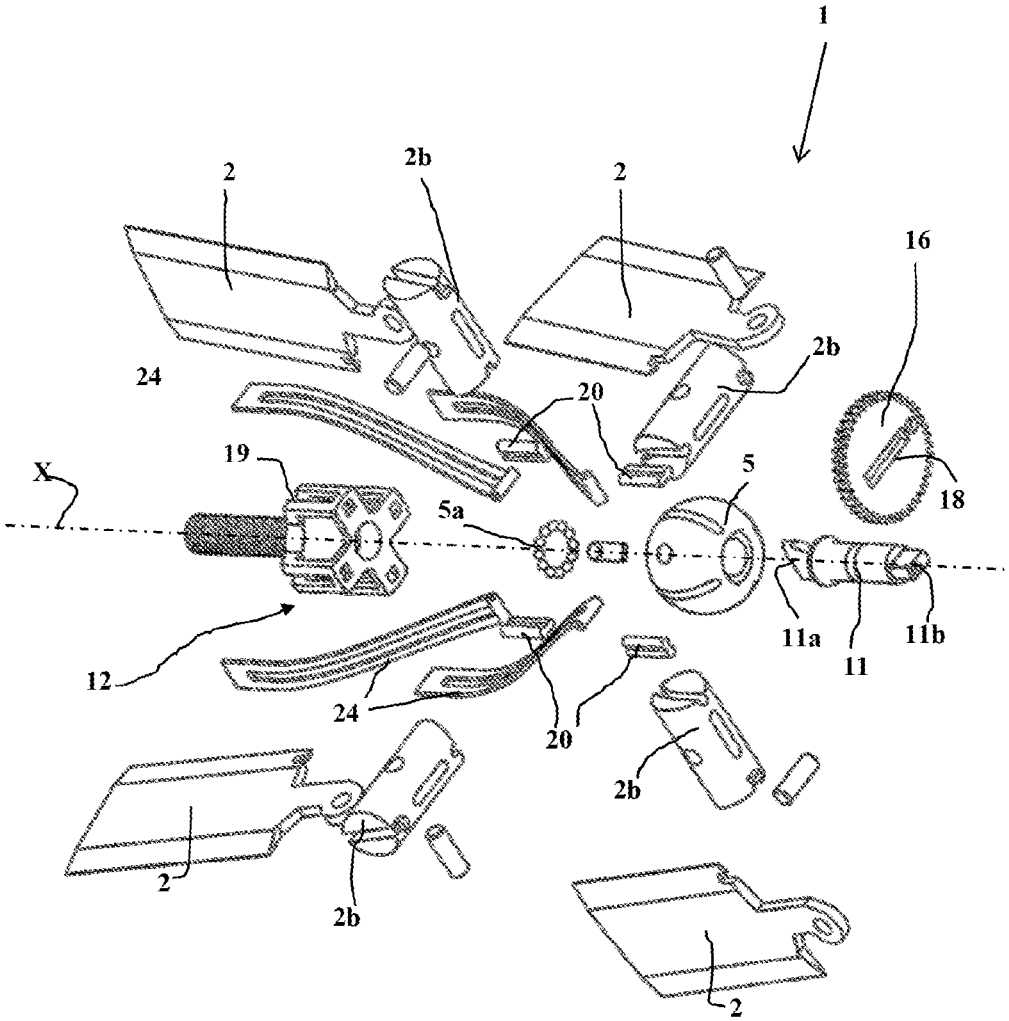
FIG. 2 shows an exploded view of the steering device of the projectile according to the invention.

According to FIG. 2, the steering device 1 comprises control surfaces 2 shown here in their folded position and with a number of four control surfaces 2. The one skilled in the art could choose to provide the projectile with at least two control surfaces or more, in even or odd number, and regularly and angularly distributed around the projectile.

Each control surface 2 comprises a directing plane whose base is integral with a first end of a control surface foot 2*b* intended to be pivotally mounted in a cylindrical and radial bore of the body of the projectile 100 (not shown). The control surfaces feet 2*b* are connected to central control means 5 by transmission members 20. The orientation of the central control means 5 is piloted by a control arm 11 which is pivotally mounted with respect to the central control means 5 using a ball bearing 5*a* (mounting visible in FIG. 6*a*).

Figure 3:
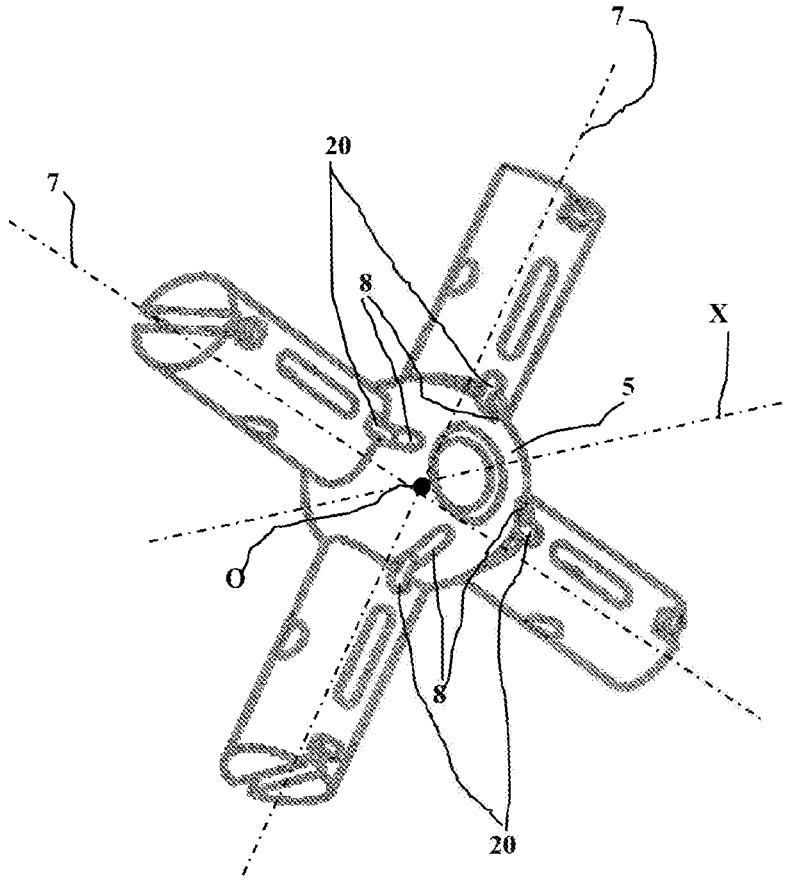
FIG. 3 shows a detailed view of the steering device without any positioning means.

As in patent FR3002319, the central control means 5 comprises at least one spherical form 5 whose center O is located on the longitudinal axis X of the projectile 100 and on the pivot axes 7 of the control surfaces 2 (the spherical form or sphere 5 will be better seen in FIG. 3).

Figure 6A:
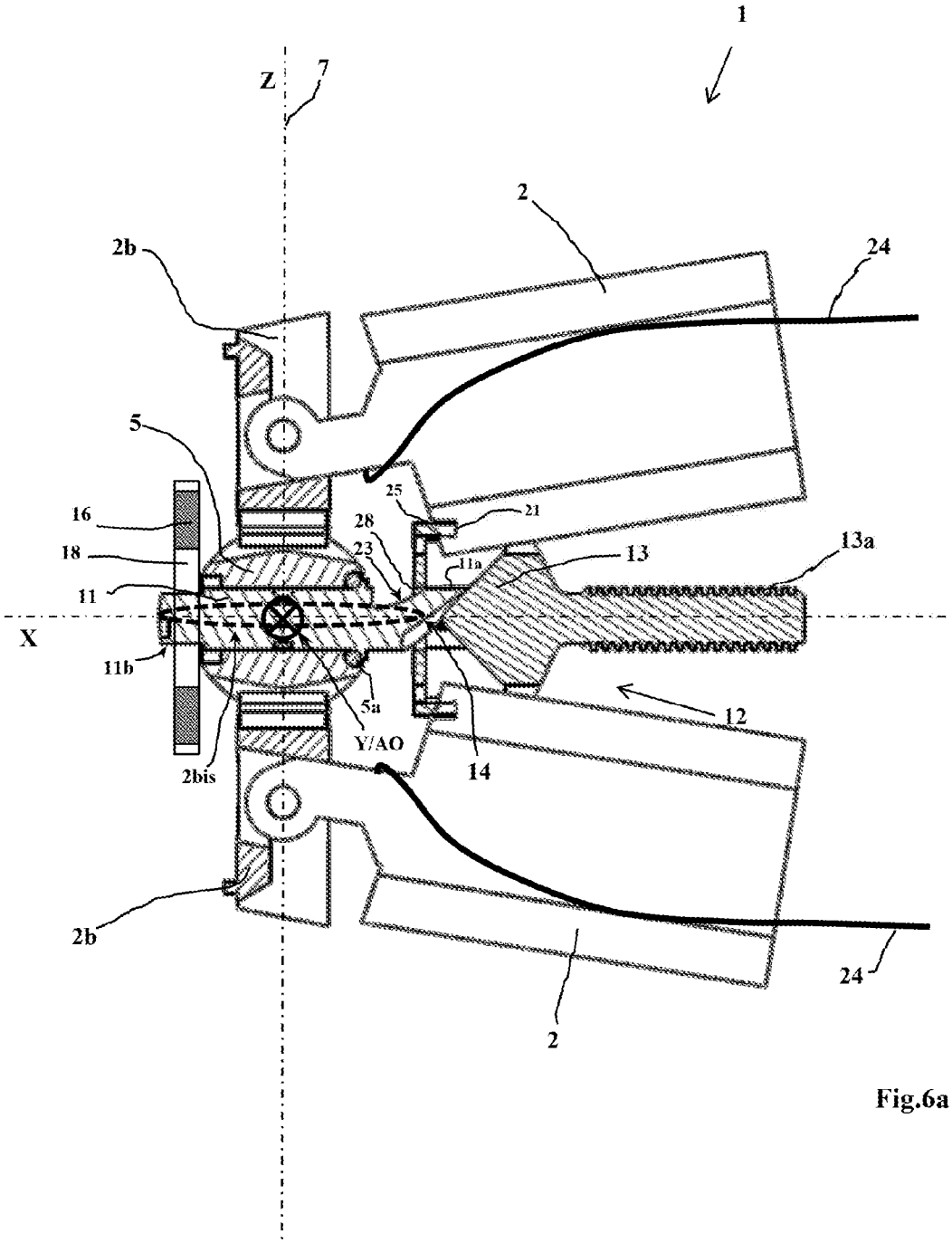
FIG. 6*a* shows a partial longitudinal cross-sectional view of a steering device with the control surfaces having been folded.
Figure 6B:
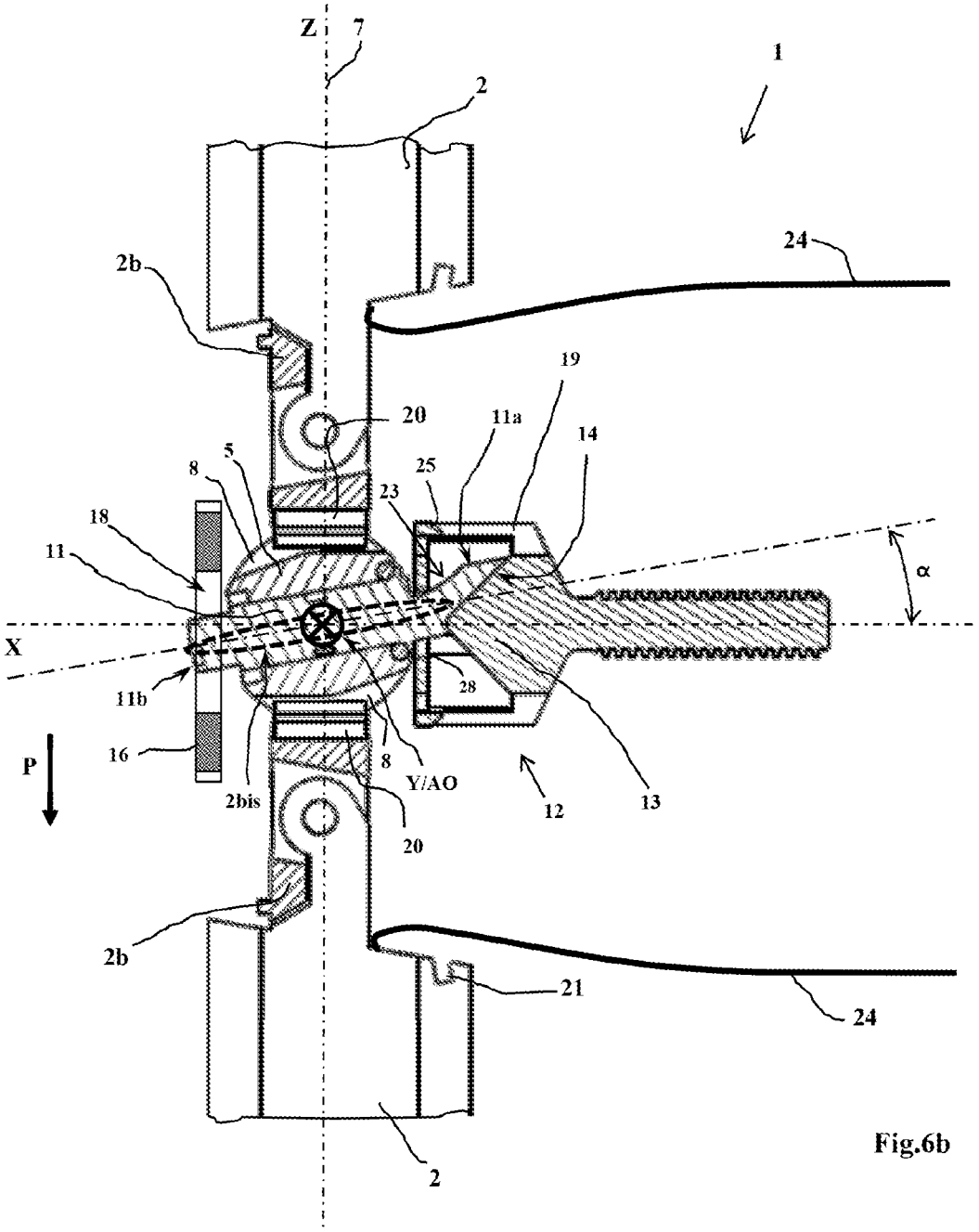
FIG. 6*b* shows a partial longitudinal cross-sectional view of a steering device with the control surfaces having been unfolded.

According to the embodiment shown, the central control means 5 is thus a sphere 5 comprising meridian grooves 8. There are as many grooves 8 as control surfaces 2. In FIGS. 6*a* and 6*b*, it can be noted that, when the control surfaces 2 are oriented at zero incidence (also referred to as the neutral position), the grooves 8 of the sphere 5 are parallel to the longitudinal axis X. The control arm 11 is then coaxial to this axis X.

Figure 4:
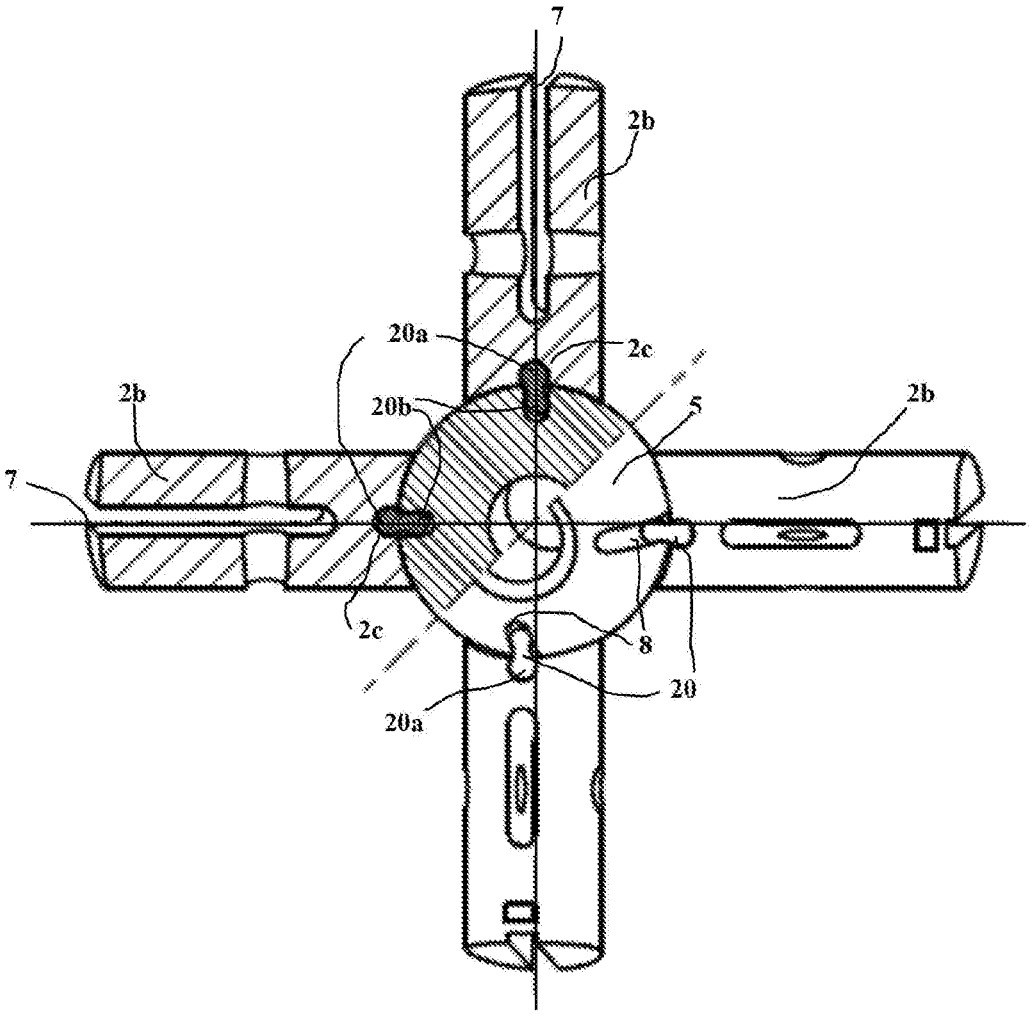
FIG. 4 shows a schematic partial cross-sectional view of torque transmitting means.

As visible in FIGS. 3, 4 and 6*a*, between the sphere 5 and the control surface foot 2*b*, there is a transmission member 20 intended to transmit, to the control surface 2, only the rotation movements of the sphere 5 around the pivot axes 7 in pitch and yaw of the control surfaces 2.

As it can be seen in FIG. 4, each transmission member 20 cooperates, by means of a first profile 20*a*, with a slot 2*c* of the control surface foot 2*b* and cooperates, by means of a second profile 20*b*, with a groove 8 of the sphere 5. The first and second profiles 20*a* and 20*b* have a lobe shape (partially cylindrical profile) adapted to slide and pivot in the slot 2*c* and the groove 8, respectively, so as to advantageously accommodate the differences in axial alignment between the control surface foot 2*b* and the sphere 5 while transmitting the movements of the sphere 5, which provide a torque that can pivot the control surface foot 2*b* around its pivot axis 7.

Such a solution is simpler and less cumbersome than the Oldham joints proposed in patent FR3002319.

To vary the incidence of the control surfaces 2, it is just necessary to pivot the sphere 5. To this effect, the first end 11*a* of the control arm 11, which is accommodated in a bore of the sphere, is oriented upwards by rotating it around an axis AO, so-called orientation axis, passing through the center of the sphere 5 (see FIG. 6*b*).

The arm 11 causes the sphere 5 to pivot at an angle $\alpha$ around the axis AO. In the specific case shown, a first pair of control surfaces 2 has its pivot axis 7 contained in the plane K containing the yaw axis Z and a second pair of control surfaces 2*bis* has its pivot axis 7*bis* collinear with the pitch axis Y which is also collinear with the orientation axis AO.

For each control surface of the second pair 2*bis*, the transmission member 20*bis* (not visible) thus transmits a pivot torque to the control surfaces 2*bis* via its first and second profiles (not visible in these figures) which correspond to the groove of the sphere 5 and the control surface foot 2*bis*, respectively, thereby placing the control surfaces 2*bis* at an incidence $\alpha$.

At the same time, the grooves 8 associated with the control surfaces 2, with the pivot axis 7 collinear to the yaw axis Z, are oriented parallel to the longitudinal axis X and, thus, do not have any incidence angle. The first profile 20*a* of each transmission member 20 associated with the control surfaces 2 with no incidence cannot transmit forces but allows the groove 8 associated therewith to slide without pivoting the control surfaces 2 which remain then in the plane K defined by the axes X and Z at zero incidence.

When the projectile and all the control surfaces 2 and 2*bis* are in rotation R around the longitudinal axis X, the sphere 5 is rotated by the transmission members 20 and 20*bis* on the side walls of the grooves 8. Considering that the previous upwards position given to the first end 11*a* of the arm 11 is kept, the pivot axis 7 of each pair of control surfaces 2 and 2*bis* will successively pass through the plane K and a plane normal to this plane K. Thus, each groove 8 will alternately and gradually be subjected to an inclination by an angle α when the control surface axis 7 will pass through the plane normal to the plane K and will be aligned on the longitudinal axis X when the pivot axis 7 of the control surface 2 will pass through the plane K.

Therefore, regardless of the angular position of the control surfaces 2 around the longitudinal axis X, the control surfaces 2 always adopt the incidence adapted to generate a lift force P in the direction given by the position of the second end 11*b* of the arm 11 (downwards in FIG. 6*b*).

To obtain the movement of the arm 11 in the plane K around the axis Y, the projectile comprises positioning means 12.

As visible in FIGS. 6*a* and 6*b*, this positioning means 12 comprises a cone 13 that is axially movable along the roll axis X by means of a screw pitch 13*a* and that is intended to interfere with a ramp 14 located at the first end 11*a* of the control arm 11, the ramp 14 being inclined with respect to the longitudinal axis of the control arm 11.

Preferably, this ramp 14 will have an inclination with respect to the longitudinal axis of the arm 11 lower than that of the cone 13 with respect to the longitudinal axis X of the projectile and will adopt a curved profile so as to provide more progressivity for when the incidence of the control surfaces 2 increases. The ramp 14 could have a shape of a cone portion comprising a tip adapted to fit with the tip of the cone 13 so as to form an end stop.

Figure 5:
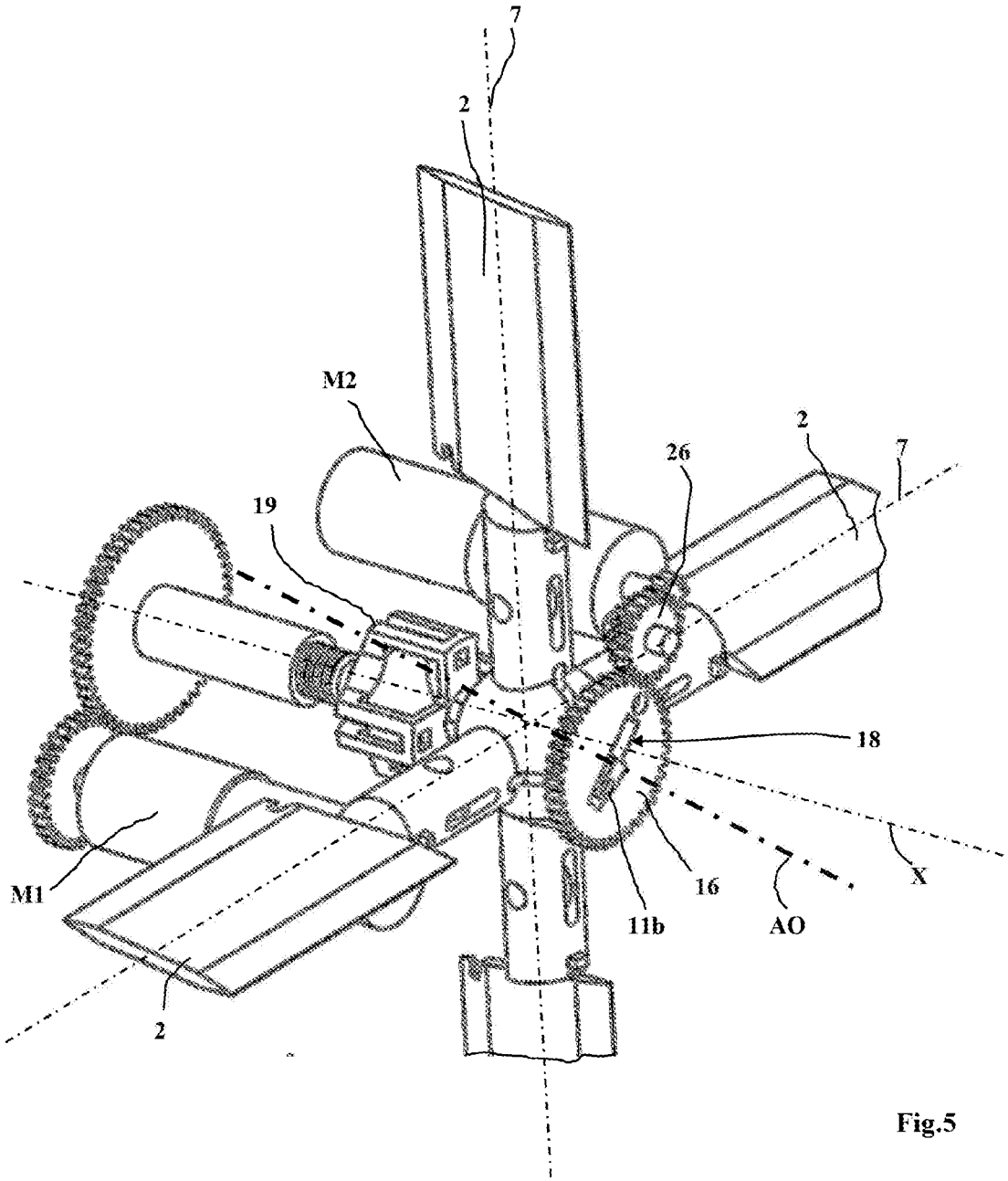
FIG. 5 shows a three-quarter view of a steering device of the projectile according to the invention.

It could also be noted, in FIGS. 6*a* and 6*b*, that the cone 13 is surrounded by a cage 19 (see also FIG. 5). This cage 19 comprises four bent edges 25 intended to match with notches 21 of the control surfaces 2, thus constituting locking means 22 making it possible to lock the control surfaces 2 in a position folded in the projectile when the positioning means 12 is in a so-called neutral position in which the cone 13 is located away from the ramp 14 as in FIG. 6*a* (the distance between the ramp 14 and the cone 13 is not visible).

In order to control the deployment of the control surfaces 2, a movement of the cone 13 from the neutral position towards the ramp 14 is performed under the action of a first motor M1 (motor visible in FIG. 5), also referred to as incidence motor M1. This movement moves the cage 19 and disengages the bent edges 25 from the notches 21 of the control surfaces 2 which, under the action of spring leaves 24, are radially deployed and blocked in this position by each spring leaf 24 pressing on the foot of the control surface 2 (FIG. 6*b*).

By continuing its movement towards the ramp 14, the cone 13 interferes therewith and causes the control arm to gradually pivot around the orientation axis AO centered on the sphere 5, thereby causing a gradual increase in the incidence of the control surfaces 2*bis* located on this axis AO as previously described.

When an incidence-decreasing correction or a return to the neutral position is desired, the elevation motor M1 causes a translation of the cone from the so-called piloting position that it occupies when it induces an incidence of the control surfaces 2, to the initial so-called neutral position in which the arm 11 is aligned on the longitudinal axis X of the projectile. To this effect, the positioning means 12 comprises return means 28 integral with the cage 19, which is constituted by a bore 28 of the cage which surrounds the control arm 11 and which is coaxial to the longitudinal axis X of the projectile.

When the cage 19 is caused to translate to the neutral position, the edge of the bore 28 interferes with the control arm 11 at a counter-ramp 23 and gradually realigns the arm 11 with the longitudinal axis of the projectile. The counter-ramp 23 comprises a profile (for example, conical) allowing the edge of the bore 28 to gradually tilt the arm 11 along with the movement of the cage 19 towards the neutral position.

The positioning means 12 makes it possible to adjust the amount of desired correction, namely the maximum pivot angle for the control surfaces 2. The more the motor M1 advances the cone 13, the more the maximum angle α for the control surfaces during the rotation of the projectile is.

In order to control the direction of the trajectory of the projectile, it is necessary that the arm is oriented in an absolute reference frame in the direction desired for the trajectory correction. In practice, the orientation axis AO for the trajectory correction is the axis passing through the center of the sphere 5 and perpendicular to the arm 11. When the control surfaces, during the rotation of the projectile, have their axis 7 becoming identical to the orientation axis AO, their incidence is maximal and the correction is maximal. Therefore, the projectile is steered along the direction perpendicular to the orientation axis AO.

In order to control the orientation of the direction of the orientation axis AO (thus, the trajectory correction), it is thus necessary to move the second end 11*b* of the arm 11. A second motor M2 (visible in FIG. 5), also referred to as steering motor M2, makes it possible to mesh a pinion 26 with a toothed wheel 16 located at the second end 11*b* of the arm 11.

Figure 7:
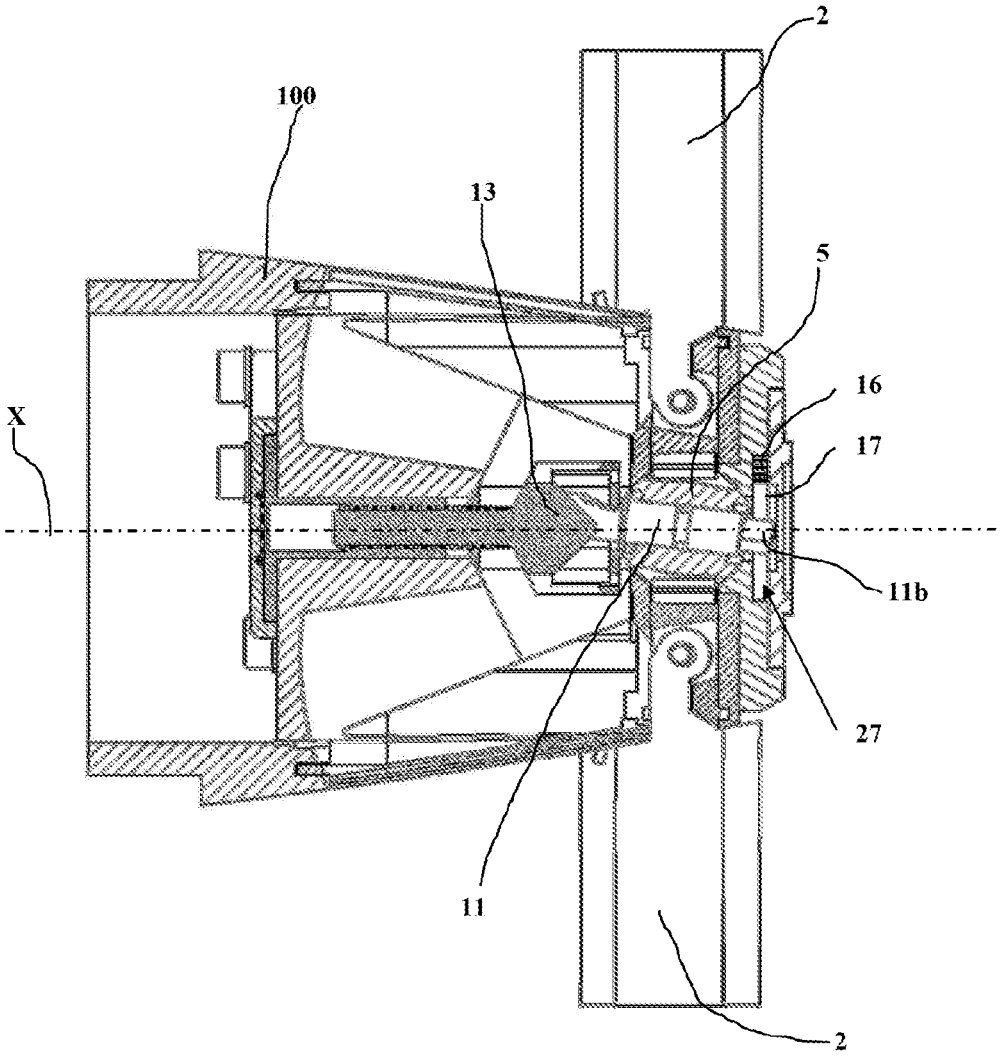
FIG. 7 shows a partial longitudinal cross-sectional view of a steering device with the control surfaces having been unfolded and located in a projectile according to the invention.

This wheel 16 is centered on the longitudinal axis X or roll axis X of the projectile. To ensure its centered support, it is contained in a housing 27 of the projectile (visible in FIG. 7). This housing 27 makes it possible to guide the wheel 16 in rotation while keeping it coaxial to the roll axis X.

The wheel 16 carries a rectilinear and diametrical groove 18 in which the second end 11*b* of the arm 11 moves, which has a rectangular lug shape cooperating with the groove 18.

Thus, the second end 11*b* of the arm 11 and the groove 18 are in sliding connection. The groove 18 has its longitudinal direction oriented perpendicularly to the longitudinal axis X of the projectile, but it is also perpendicular to the orientation axis AO.

Therefore, when the toothed wheel 16 rotates with respect to the absolute reference frame, the groove 18 causes the control arm 11 to pivot around the longitudinal axis X, thereby varying the angular position of the orientation axis AO in the absolute reference frame.

The control surfaces, when crossing the orientation axis, will have their maximum incidence and thus apply a lift force tending to deviate the projectile in the direction parallel to the groove 18, in other words perpendicularly to the orientation axis AO.

To ensure the piloting, it is just necessary to control, on one hand, the axial position of the cone 13 which provides the maximum amount for the pivoting α of the control surfaces and, on the other hand, the orientation, in the absolute reference frame, of the groove 18 which is perpendicular to the orientation axis AO. This orientation of the groove 18 can be measured using an optical sensor which is integral with the projectile body and which will read an encoder ring carried by the wheel 16. The position of the projectile in an absolute reference frame will be known by means of an inertial navigation unit carried by the projectile. Thus, an onboard computer could easily know the position of the groove 18 in the absolute reference frame and control the motors M1 and M2 according to the orientation desired for the trajectory correction.

The control law for the motors M1 and M2 must take into account the permanent gyration of the projectile on itself so as to compensate it. A simple acceleration or a temporary slowdown of the rotation speed of the motors M1 and M2 will be sufficient to control the incidence of the control surfaces and the orientation of the orientation axis in the absolute reference frame.

The device makes it possible for a projectile according to the invention to be easily steerable while orienting the control surfaces in a reliable manner. The control solution provided by the invention is simpler than that described by patent FR3002319.

The invention claimed is:

1. A projectile with incidence steerable control surfaces, the projectile comprising at least two control surfaces, each control surface being pivotable with respect to the projectile around a pivot axis perpendicular to a longitudinal axis of the projectile, the projectile further comprising:

central control means for controlling the control surfaces, the central control means comprising at least one spherical form a center of which is located on the longitudinal axis, said at least one spherical form being arranged in a housing of the projectile, a control arm integral with said at least one spherical form and adapted to rotate said at least one spherical form at least around pitch and yaw axes of the projectile passing through the center of said at least one spherical form, for each control surface, a transmission member cooperating with said at least one spherical form by a first side and with a foot of said each control surface by a second side, the transmission member being intended to transmit to said each control surface the rotation movements of the spherical form around the pivot axis of the control surface, positioning means for positioning the arm, the positioning means being adapted to position one end of the arm in a position determined with respect to an absolute reference frame centered on the longitudinal axis of the projectile, wherein:

the positioning means comprises a cone movable in translation along the longitudinal axis of the projectile between a first, so-called neutral, position and a second, so-called piloting, position in which the cone pushes a ramp carried by a first end of the control arm so as to pivot the central control means around a so-called orientation axis passing through the center of the central control means, the central control means is freely rotatable around the longitudinal axis of the control arm, the positioning means comprises a toothed wheel centered on the longitudinal axis of the projectile and connected to a second end of the arm by a sliding connection located in the plane of the toothed wheel and perpendicular to the orientation axis, the toothed wheel meshing with a motorization intended to pilot the angular position of the orientation axis in an absolute reference frame.

2. The projectile according to claim 1, wherein the positioning means comprises return means for returning the arm to a position aligned with the longitudinal axis of the projectile, thus placing the control surfaces at zero incidence.

3. The projectile according to claim 2, wherein the return means is integral in translation with the cone and comprises a bore coaxial to the longitudinal axis of the projectile and an edge of which is intended to interfere with a counter-ramp of the arm when the cone returns in neutral position by moving away from the first ramp.

4. The projectile according to claim 3, wherein the cone is integral with a cage which surrounds the cone and carries the bore.

5. The projectile according to claim 4, wherein the positioning means comprises locking means for locking the control surfaces in a position folded in the projectile, the locking means comprising a bent outer edge integral with the cage, the edge being intended to cooperate with a notch of a leading edge of a control surface in order to maintain the control surface folded when the cone is in the neutral position.

6. The projectile according to claim 1, wherein the positioning means comprises locking means for locking the control surfaces in a position folded in the projectile.

7. The projectile according to claim 1, wherein said at least one spherical form comprises, for said each control surface, a groove oriented along a meridian line of the spherical form and starting from the control arm, the grooves being arranged parallel to the longitudinal axis of the projectile when the control surfaces themselves are parallel to the longitudinal axis of the projectile.

8. The projectile according to claim 7, wherein each groove cooperates with a so-called second profile of the transmission member that corresponds to the groove, the second profile being adapted to slide and pivot in the groove.

9. The projectile according to claim 8, wherein the transmission member comprises a so-called first profile that is parallel to the second profile, the first profile cooperating with a slot carried by the foot of the control surface, the first profile being adapted to slide and pivot in the slot.

10. The projectile according to claim 9, wherein the first and second profiles of the transmission member each comprise a lobe shape adapted to cooperate, on one hand, with the grooves of the spherical form and, on the other hand, with the slot of the control surface foot.

* * * * *